United States Patent [19]

Swidler

[11] Patent Number: 5,069,995

[45] Date of Patent: Dec. 3, 1991

[54] STAIN ELIMINATION IN CONSECUTIVE COLOR TONING

[75] Inventor: Ronald Swidler, Palo Alto, Calif.

[73] Assignee: CommTech International Management Corporation, Menlo Park, Calif.

[21] Appl. No.: 356,264

[22] Filed: May 23, 1989

[51] Int. Cl.[5] ..... G03G 9/00; G03G 5/00

[52] U.S. Cl. ..... 430/115; 430/112; 430/114; 430/137

[58] Field of Search ..... 430/115, 137, 114, 112

[56] References Cited

U.S. PATENT DOCUMENTS

| | | | |
|---|---|---|---|
| 2,986,521 | 5/1961 | Wielicki . | |
| 3,012,969 | 12/1961 | van der Minne et al. . | |
| 3,052,539 | 9/1962 | Greig . | |
| 3,060,021 | 10/1962 | Greig . | |
| 3,253,913 | 5/1966 | Smith et al. . | |
| 3,285,837 | 11/1966 | Neber . | |
| 3,337,340 | 8/1967 | Matkan et al. . | |
| 3,345,293 | 10/1967 | Bartoszewicz et al. . | |
| 3,406,062 | 10/1968 | Michalchik . | |
| 3,411,936 | 11/1968 | Roteman et al. . | |
| 3,417,019 | 12/1968 | Beyer . | |
| 3,533,093 | 1/1971 | Putnam et al. . | |
| 3,672,887 | 6/1972 | Matsumoto et al. . | |
| 3,687,661 | 8/1972 | Sato et al. . | |
| 3,779,924 | 12/1973 | Chechak . | |
| 3,788,995 | 1/1974 | Stahly et al. . | |
| 3,849,165 | 11/1974 | Stahly et al. . | |
| 4,081,391 | 3/1978 | Tsubuko et al. . | |
| 4,156,034 | 5/1979 | Mukoh et al. | 430/115 X |
| 4,167,503 | 9/1979 | Cipriani | 524/336 |
| 4,170,563 | 10/1979 | Merrill et al. . | |
| 4,202,785 | 5/1980 | Merrill et al. . | |
| 4,229,513 | 10/1980 | Merrill et al. . | |
| 4,460,672 | 7/1984 | Gruber et al. | 430/110 |
| 4,556,624 | 12/1985 | Gruber et al. | 430/110 |
| 4,564,574 | 1/1986 | Uytterhoeven et al. . | |
| 4,654,282 | 3/1987 | Ng et al. . | |
| 4,701,387 | 10/1987 | Alexandrovich . | |
| 4,719,165 | 1/1988 | Kitatani et al. | 430/115 |
| 4,725,867 | 2/1988 | Ng et al. . | |
| 4,728,983 | 3/1988 | Zwadlo et al. . | |
| 4,762,764 | 8/1988 | Ng et al. . | |
| 4,879,199 | 11/1989 | Gruber et al. | 430/137 |
| 4,931,506 | 6/1990 | Yu | 525/187 |

FOREIGN PATENT DOCUMENTS

| | | | |
|---|---|---|---|
| 0848902 | 8/1970 | Canada | 430/115 |
| 0148751 | 9/1982 | Japan | 430/114 |
| 59-87463 | 5/1984 | Japan . | |
| 60-73545 | 4/1985 | Japan . | |
| 63-52376 | 10/1988 | Japan . | |
| 1442835 | 7/1976 | United Kingdom . | |

OTHER PUBLICATIONS

Walter J. Wnek et al, "A Review of Dry and Liquid Toner Technology", The 1988 Datek Imaging Supplies Annual, pp. 52–63.

*Primary Examiner*—Marion E. McCamish
*Assistant Examiner*—Stephen Crossan
*Attorney, Agent, or Firm*—Dianne E. Reed

[57] ABSTRACT

A novel liquid developer composition for use in electrophotographic processes, particularly consecutive color toning, is described. The composition contains, dispersed in a hydrocarbon medium, toner particles of colorant-containing resin and an antistatic agent substantially immiscible with the resin. The antistatic agent effectively eliminates the image staining frequently obtained in consecutive color toning processes. Methods for preparing and using the novel composition are also provided.

19 Claims, No Drawings

STAIN ELIMINATION IN CONSECUTIVE COLOR TONING

TECHNICAL FIELD

The present invention relates generally to the field of electrophotography, and more particularly relates to a novel liquid developer composition for use in consecutive color toning. The invention also relates to methods for making and using the novel compositions.

BACKGROUND

Preparation of printed images by electrophotographic (or "xerographic") processes involves coating a selected substrate, or xerographic plate (typically comprised of metal, glass or plastic), with a photoconductive insulating material such as selenium, and then providing an electrostatic charge on the photoconductive surface, e.g., by ionization from a corona discharge. A light image is then focused onto the charged surface, which discharges or lowers the potential of the irradiated areas, while leaving the remainder of the surface charged. The electrostatic image so formed is then made visible by application of a suitable developing composition, which may be in either dry or liquid form.

Conventional liquid developer compositions comprise a dispersion of pigment particles in an insulating carrier liquid. Application of such a composition to the substrate carrying the electrostatic image results in migration of charged pigment particles to the substrate surface and deposition thereon in conformance with the electrostatic image. The developed image is then transferred to another surface such as paper. (In some cases, it may be possible to eliminate the intermediate step of image transfer, i.e., so that the developed image is directly produced upon the final surface; see, e.g., U.S. Pat. No. 3,052,539 to Greig.)

The earliest liquid developers were dispersions of pigment particles such as carbon black in a petroleum distillate. To charge the pigment particles, a charge control agent such as a metal salt was incorporated into the developer composition. The main problem with these early developers was instability; the pigment tended to settle out of the dispersion medium. In addition, attractive forces between the pigment particles resulted in formation of large aggregates, in turn further destabilizing the dispersion and giving rise to a poor quality image. In an attempt to overcome these difficulties, resinous dispersants were incorporated into the composition.

Color liquid developers are relatively recent, and are similarly comprised of colorant imbibed in a thermoplastic resin core, these "toner" particles dispersed in an insulating carrier medium as above. The four-color liquid electrophotographic process in which these developers are currently used involves "consecutive color toning", a technique which comprises: (1) charging a photoconductive (pc) surface; (2) impressing a first latent image on the surface by exposure through a colored transparency; (3) developing the image by contacting the pc with a liquid developer composition of a first color, typically yellow; and (4) optically discharging the pc surface. The steps are then repeated in sequence, typically using magenta, cyan, and black developer compositions, i.e., the cyclic process is repeated until the colored image is complete.

A significant problem which has been encountered in consecutive color toning is "image" or "character" staining, that is to say, where a second process color overtones the first image in regions where portions of the first image should have been discharged but were not. See, for additional explanation of the problem, R. M. Schaffert, *Electrophotography* (London: Focal Press, 1975), at pp. 184–186.

Many schemes have been advanced to overcome this difficulty. In U.S. Pat. No. 4,701,387 to Alexandrovich et al., for example, the problem of residual toner is discussed. The inventors propose a solution wherein the developed surface is rinsed with a polar liquid after each development step. It is suggested that application of a polar rinse liquid neutralizes and solvates residual counterions deriving from charge control agents and stabilizers present in the liquid developer.

While the Alexandrovich et al. method may be effective in reducing the staining problem, such a multiple washing procedure is time-consuming and unwieldy (it is recommended in the '387 patent that "after each development step and before the next developer is applied, the developed image is rinsed.... After rinsing, the rinse liquid is removed from the photoconductive element by drying, wiping or other method...."; see col. 2, lines 62–67).

The inventor herein proposes a novel solution to the problem of image staining in consecutive color toning which substantially eliminates the cause of the problem and avoids the time-consuming, multiple washing procedure of the prior art. It has now been found that incorporation of an antistatic agent into a liquid developer composition, preferably at the stage of toner manufacture, provides for significantly reduced image staining, and a final image of exceptionally high quality, both respect to image density and edge acuity. The novel compositions also enable the use of much higher speed electrophotographic equipment and processes.

DESCRIPTION OF THE PRIOR ART

R. M. Schaffert, *Electrophotography* cited supra, provides a comprehensive overview of electrophotographic processes and techniques. Representative references which relate to the field of color electrophotography, specifically, include U.S. Pat. Nos. 3,060,021 to Greig, 3,253,913 to Smith et al., 3,285,837 to Neber, 3,553,093 to Putnam et al., 3,672,887 to Matsumoto et al., 3,687,661 to Sato et al., and 3,849,165 to Stahly et al. References which describe electrophotographic toners and developers include U.S. Pat. Nos. 2,986,521 to Wielicki, 3,345,293 to Bartoszewicz et al., 3,406,062 to Michalchik, 3,779,924 to Chechak, and 3,788,995 to Stahly et al.

U.S. Pat. No. 4,701,387 to Alexandrovich et al., discussed in the preceding section, and U.S. Pat. No. 3,337,340 to Matkan, are also relevant insofar as each of these references relates to the problem of image staining in consecutive color toning.

SUMMARY OF THE INVENTION

Accordingly, it is a primary object of the invention to provide a process for substantially eliminating the problem of image staining in consecutive color toning.

It is another object of the invention to provide a liquid developer composition for use in the process, the composition formulated so as to contain an antistatic agent.

It is still another object of the invention to provide a process for making such a liquid developer composition.

It is a further object of the invention to provide an improved method of developing an electrostatic charge pattern using a consecutive color toning technique.

Additional objects, advantages and novel features of the invention will be set forth in part in the description which follows, and in part will become apparent to those skilled in the art upon examination of the following, or may be learned by practice of the invention.

In one aspect of the invention, an electrophotographic liquid developer composition is provided which comprises: an insulating carrier liquid comprising a hydrocarbon medium, and, dispersed therein, (a) toner particles comprising a resinous phase containing colorant, and (b) an antistatic agent substantially immiscible with the resinous phase.

In another aspect of the invention, a process is provided for preparing an electrophotographic liquid developer composition, which process comprises:

(a) admixing colorant, resin and an antistatic agent substantially immiscible with the resinous phase, at a temperature in the range of about 100° C. to 200° C., to give an admixture;

(b) comminuting the admixture provided in step (a), without addition of solvent, to give intermediate particles;

(c) subjecting said intermediate particles to liquid attrition in a selected solvent, to give toner particles; and (d) preparing a dispersion of said toner particles in an insulating carrier liquid comprising a hydrocarbon medium.

This method thus involves incorporation of the antistatic agent into the developer composition at the stage of toner manufacture. In a variation on this method, the antistatic agent is admixed into the composition after dispersion of toner in the selected carrier liquid.

In still another aspect of the invention, an improved process is provided for developing an electrostatic charge pattern using consecutive color toning, the process comprising forming an initial electrostatic charge pattern on an insulating substrate and developing the initial pattern with a liquid developer composition comprising toner particles of a first colorant-containing resinous phase dispersed in an insulating carrier liquid, forming a second electrostatic charge pattern and developing the second pattern with a developer composition comprising toner particles of a second colorant-containing resinous phase, the improvement which comprises: incorporating a selected antistatic agent, substantially immiscible with the resinous phase, into the developer composition, either during toner manufacture or after.

In yet another aspect of the invention, the toner particles of the liquid developer composition contain a separate, solid, resin-immiscible incompatible phase such as a microcrystalline wax. Incorporation of such a phase into the toner particles to provide a fine particle developer composition is described in detail in co-pending, commonly assigned U.S. patent application Ser. No. 355,484, entitled "Fine Particle Electrophotographic Toner and Developer Compositions and Process Therefor", inventor Ronald Swidler, filed on even date herewith and incorporated by reference herein. In this embodiment, the liquid developer composition contains both an antistatic agent and a separate, solid, incompatible phase incorporated into the toner particles.

As established in the Example herein, the liquid developer composition of the invention provides for substantially reduced image staining in consecutive color toning. Image staining, as noted above, is believed to result from a residual surface charge (presumably resident on the dielectric toner pile) which remains after each exposure step. The present invention, by virtue of the antistatic agent incorporated into the liquid developer composition, addresses the problem by neutralizing residual surface charge, i.e., by "bleeding" the excess charge to the air.

DETAILED DESCRIPTION OF THE PREFERRED EMBODIMENT

The presently claimed invention thus provides a liquid developer composition, a process for preparing the developer composition, and an improved method of developing an electrostatic charge pattern, all of which embodiments are directed to the problem of image staining in consecutive color toning.

The focal point of the aforementioned compositions and methods is on the use of an antistatic agent, i.e., by incorporation into a liquid developer composition. Virtually any antistatic agent may be used, so long as it is, first of all, substantially immiscible with the resinous phase of the toner particles. By "substantially immiscible with" is meant a tendency not to blend or mix, so that two "substantially immiscible" materials will tend to disperse freely in a given solvent, rather than tending to aggregate. It is also essential that the antistatic agent be stable under the conditions used in preparing and using the liquid developer composition, and, further, that it not react with or interfere with the function of other components in the composition, particularly charge direction. To this end, it is preferred that the antistatic agent either (1) be insoluble in the carrier liquid of the developer composition (i.e., having a solubility therein of less than about 50 ppm, preferably less than about 10 ppm), or (2) if soluble in the carrier liquid, be free of any acidic or basic moieties which could interfere with charge direction.

Suitable antistatic agents include anionic, cationic, amphoteric or nonionic surfactants.

Anionic surfactants commonly contain carboxylate, sulfonate or sulfate ions. The most common cations in these materials are sodium, potassium, ammonium, and triethanolamine, with an average fatty acid chain length of 12 to 18. Examples of anionic surfactants are long-chain alkyl sulfonates such as sodium lauryl sulfate and alkyl aryl sulfonates such as sodium dodecylbenzene sulfonate.

Cationic surfactants are typically amine salts, quaternary ammonium salts, or phosphonium salts, the compounds containing a hydrophobic moiety such as a hydroxyl, long-chain alkyl, or aralkyl substituent.

Amphoteric agents include, for example, compounds which contain carboxylate or phosphate groups as the anion—e.g., polypeptides, proteins, and the alkyl betaines—and amino or quaternary ammonium groups as the cation, compounds which typically exist in a zwitterionic state.

Non-ionic surfactants include long-chain fatty acids and their water-insoluble derivatives, e.g., fatty alcohols such as lauryl, cetyl and stearyl alcohols, glyceryl esters such as the naturally occurring mono-, di- and triglycerides, fatty acid esters of fatty alcohols and other alcohols such as propylene glycol, polyethylene glycol, sorbitan, sucrose and cholesterol. These compounds may be used as is or modified so as to contain polyoxyethylene groups.

In the preferred embodiment, the antistatic agent is a non-ionic surfactant. Examples of particularly preferred non-ionic surfactants for use herein are ethoxylated sorbitan monooleate, ethoxylated oleic acid, ethoxylated oleyl alcohol, carbowaxes, alkylaryl phenol ethoxylates, and ethoxylated amides.

The liquid developer composition of the invention is prepared by formulating toner particles and then preparing a dispersion of the particles in a selected carrier liquid. The antistatic agent may be incorporated into the composition initially, when the toner particles are prepared, or it may be added into the carrier liquid after the toner particles have been dispersed therein, or both. It is preferred, however, that the antistatic agent be incorporated into the liquid developer composition at the outset, during toner manufacture.

The toner particles of the invention are prepared as follows. Resin, colorant, and the selected antistatic agent, are blended together at a temperature in the range of about 100° C. to 200° C. A two-roll mill, an extruder, an intensive mixer or the like, is used to ensure complete mixing. The admixture is then comminuted dry, that is, without addition of solvent, to give intermediate particles typically averaging 30 microns in diameter or less. This dry comminution step is carried out in a jet mill, a hammer mill, or the like. The intermediate particles so obtained are then subjected to liquid attrition in a selected solvent, to give the final toner particles. The solvent used for liquid attrition is typically selected from the same class of solvents useful as the carrier liquid for the developer composition, as will be described below. Alternatively, the antistatic agent may be omitted from the procedure, and added into the composition after preparation of developer.

A liquid developer composition is then prepared by dispersing these toner particles in a carrier liquid. As is well known in the art, such carrier liquids may be selected from a wide variety of materials. The liquid is typically oleophilic as defined above, stable under a variety of conditions, and electrically insulating. That is, the liquid has a low dielectric constant and a high electrical resistivity so as not to interfere with development of the electrostatic charge pattern. Preferably, the carrier liquid has a dielectric constant of less than about 3.5, more preferably less than about 3, and a volume resistivity greater than about $10^9$ ohm-cm, more preferably greater than about $10^{10}$ ohm-cm. Examples of suitable carrier liquids include: halogenated hydrocarbon solvents such as carbon tetrachloride, trichloroethylene, and the fluorinated alkanes, e.g., trichloromonofluoromethane and trichlorotrifluoroethane (sold under the trade name "Freon" by the DuPont Company); acyclic or cyclic hydrocarbons such as cyclohexane, n-pentane, isooctane, hexane, heptane, decane, dodecane, tetradecane, and the like; aromatic hydrocarbons such as benzene, toluene, xylene, and the like; silicone oils; molten paraffin; and the paraffinic hydrocarbon solvents sold under the names Isopar G, Isopar H, Isopar K and Isopar L (trademarks of Exxon Corporation). The foregoing list is intended as merely illustrative of the carrier liquids which may be used in conjunction with the present invention, and is not in any way intended to be limiting.

If the toner particles have been prepared without an antistatic agent, the agent is to be incorporated into the composition at this stage. This is effected by simply dispersing or dissolving a selected amount of the desired agent into the carrier liquid containing toner.

The resins and colorants which may be used in preparing the toner particles may, like the carrier liquid, be selected from a wide variety of materials well known in the art of electrophotography.

Resins useful in liquid electrophotographic developers, generally, are characterized as being insoluble or only slightly soluble in the insulating carrier liquid. Examples of suitable resins for use herein include: alkyd and modified alkyd resins cured with polyisocyanate, melamine formaldehyde or benzoguanamine; epoxy ester resins; polyester resins; copolymers of styrene, acrylic and methacrylic esters with hydroxyethyl methacrylate, hydroxyethyl acrylate, hydroxypropyl methacrylate, or the like; other polyacrylates; phenolic resins such as phenol formaldehyde resins and derivatives thereof; ethylene-acrylic acid copolymers; ethylene-vinyl alcohol copolymers and ionomers thereof; styrene-allyl alcohol copolymers; cellulose acetate-butyrate copolymers; and polyethylene and polyethylene copolymers.

The colorants which may be used include virtually any pigments, dyes and stains which may be suspended in the carrier liquid and which are effective to make visible the electrostatic latent image. Examples of suitable colorants include: Phthalocyanine blue (C.I. 74160), Diane blue (C.I. 21180), Milori blue (an inorganic pigment equivalent to ultramarine) as cyan colorants; Brilliant carmine 6B (C.I. 15850), Quinacridone magenta (C.I. Pigment Red 122) and Thioindigo magenta (C.I. 73310) as magenta colorants; benzidine yellow (C.I. 21090 and C.I. 21100) and Hansa Yellow (C.I. 11680) as yellow colorants; organic dyes; and black materials such as carbon black, charcoal and other forms of finely divided carbon, iron oxide, zinc oxide, titanium dioxide, and the like.

The optimal weight ratio of colorant to resin in the toner particles is on the order of about 1:1 to 25:1, more preferably about 5:1 to 15:1. The total dispersed material in the carrier liquid typically represents 0.5 to 5 wt% of the composition, while the antistatic agent is included at about 0.1 to 5 wt.%, i.e., relative to the total developer composition.

The developer composition optionally includes a charge director, sometimes also referred to as a charge control agent, to provide uniform charge polarity on the toner particles. The charge director is absorbed on the surface of the toner particle and imparts an electrical charge of a selected polarity, i.e., either positive or negative. Any number of charge directors known in the art can be used herein, e.g., those described in *Research Disclosure,* May 1973, at page 66, as well as in U.S. Pat. Nos. 3,012,969 to van der Minne et al. (polyvalent metal organic salts in combination with an oxygen-containing organic compound), U.S. Pat. No. 3,411,936 to Rotsman et al. (metallic soaps), U.S. Pat. No. 3,417,019 to Beyer (metallic soaps and organic surface active agents), U.S. Pat. Nos. 3,788,995 to Stahly et al. (various polymeric agents), 4,170,563 to Merrill et al. (phosphonates), 4,229,513 (quaternary ammonium polymers), and 4,762,764 to Ng (polybutene succinimide, lecithin, basic barium petroleum sulfonates, and mixtures thereof).

The developer composition may include other components as desired, including dispersing agents, stabilizers, and an incompatible phase such as a microcrystalline wax. As described in co-pending, commonly assigned U.S. patent application Ser. No. 355,484, entitled "Fine Particle Electrophotographic Toner and Developer Compositions and Process Therefore," previously incorporated by reference herein, inclusion of a separate, solid, resin-immiscible phase into the toner particles substantially prevents pigment exposure and particle aggregation, while enabling preparation of a very fine particle composition and an ultimate image that is of exceptionally high quality.

As described in detail in the above-cited patent application, the incompatible phase may comprise any material which can be incorporated into the toner particles using the above-described process, and which will result in a separate, solid phase, i.e., a phase that is distinct from the remaining, resinous phase of the toner particle. It is preferred that the incompatible phase, like the resinous phase, be of a material that does not swell in the carrier liquid. Particularly preferred materials for use as the incompatible phase are microcrystalline, fractile waxes, e.g., carnauba wax, beeswax, candellila wax, amide waxes, urethane-modified waxes (e.g., Petrolite WB-type), montan wax, Carbowax (Union Carbide), paraffin waxes, long-chain petroleum waxes, and other waxes as described in U.S. Pat. Nos. 3,060,021 and 4,081,391, both of which are incorporated herein by reference.

In this alternative embodiment, then, the liquid developer composition of the invention contains both an oleophilic phase incorporated into the toner particles and an antistatic agent. Inclusion of both moieties into the present composition provides for an electrostatic image of overall better quality than obtained with analogous prior art techniques.

It is to be understood that while the invention has been described in conjunction with the preferred specific embodiments thereof, that the foregoing description as well as the examples which follow are intended to illustrate and not limit the scope of the invention. Other aspects, advantages and modifications within the scope of the invention will be apparent to those skilled in the art to which the invention pertains.

EXAMPLE

A liquid developer composition was prepared by melting resin (175 g AC540, an ethylene-acrylic copolymer manufactured by Allied Chemical Corp., Morristown, New Jersey; and 175 g AC201A, an ionomer of AC580, also manufactured by Allied Chemical Corp.) and admixing therewith the following: 62.8 g Sico Fast Yellow DN55, 25 g WB11, a cationic wax dispersant (Petrolite), and 25 g carnauba wax. The resultant mixture was comminuted by hammer milling, followed by liquid attrition in Isopar H (Exxon) using a Union Process 01 apparatus. The particle surface area in these dispersions was monitored in a Horiba particle analyzer. The surface area of the toner particles averaged approximately 4.3 $m^2/g$. A 2% developer composition was prepared by dispersing these toner particles in 130 g Isopar H (Exxon). Magenta, cyan and black developer compositions were prepared in this way, as well.

Liquid developer compositions containing an antistatic agent were then prepared as follows. Resin, dyes, WB11 and wax were admixed as described above, except that 15 g Tween 80 (ICI) were incorporated into the admixture. Comminution and attrition were carried out as in the preceding section, and 2% developer compositions were prepared with Isopar H.

Series of tests were then conducted using the two types of developer compositions, i.e., with and without the antistatic agent Tween 80, in consecutive color toning Photoconductive substrates (ZnO) were charged, exposed and developed in untoned areas using each of the two types of developer compositions, in the four-color development sequence yellow, magenta, cyan and black. The composition without the antistatic agent resulted in a noticeable degree of image staining, while the composition containing the antistatic agent resulted in virtually no noticeable image staining.

I claim:

1. An electrophotographic liquid developer composition, comprising:

an insulating carrier liquid comprising a hydrocarbon medium, and, dispersed therein, toner comprising a resinous phase containing colorant, wherein the toner is in the form of individual particles in which is incorporated an antistatic agent that is substantially immiscible with the resinous phase and substantially insoluble in the insulating carrier liquid, or, if soluble in the insulating carrier liquid, is substantially free of acidic or basic moieties.

2. The developer composition of claim 1, wherein the antistatic agent is selected from the group consisting of ethoxylated sorbitan monooleate, ethoxylated oleic acid, ethoxylated oleyl alcohol, carbowaxes, alkylaryl phenol ethoxylates, and ethoxylated amides.

3. The developer composition of claim 1, wherein the resinous phase comprises a thermoplastic resin having a softening point in the range of about 60° C. to about 150° C.

4. The developer composition of claim 3, wherein the resin is selected from the group consisting of ethylene-acrylic acid copolymers, ethylene-vinyl alcohol copolymers, styrene-allyl alcohol copolymers, cellulose acetate-butyrate copolymers, and ionomers and mixtures thereof.

5. The developer composition of claim 1, wherein the colorant comprises an organic dye.

6. The developer composition of claim 1, wherein the colorant comprises an organic dye.

7. The developer composition of claim 1, wherein the toner particles further comprise a separate, solid, incompatible phase which is a wax.

8. The developer composition of claim 7, wherein the wax is carnauba wax.

9. A process for preparing an electrophotographic liquid developer composition containing toner in an insulating carrier liquid, which process comprises:

(a) admixing colorant, resin and an antistatic agent which is substantially immiscible with the resinous phase and insoluble in the insulating carrier liquid, or, if soluble in the insulating carrier liquid, is substantially free of acidic or basic moieties, at a temperature in the range of about 100 degrees C to 200 degrees C, to give an admixture;

(b) comminuting the admixture provided in step (a), without addition of solvent, to give intermediate particles;

(c) subjecting said intermediate particle to liquid attrition in a selected solvent, to give toner particles comprising the resin and the colorant, and having incorporated therethroughout the antistatic agent; and (d) preparing a dispersion of said toner particles in the insulating carrier liquid comprising a hydrocarbon medium.

10. The process of claim 9, wherein the antistatic agent is selected from the group consisting of ethoxylated sorbitan monooleate, ethoxylated oleic acid, ethoxylated oleyl alcohol, carbowaxes, alkylaryl phenol ethoxylates, and ethoxylated amides.

11. The process of claim 9, wherein in step (a), a separate, resin-immiscible incompatible phase is incorporated into said admixture.

12. The process of claim 11, wherein said incompatible phase comprises a microcrystalline wax.

13. The process of claim 12, wherein said microcrystalline wax comprises carnauba wax.

14. In a process for developing an electrostatic charge pattern, the process comprising forming an initial electrostatic charge pattern on an insulating substrate and developing the initial pattern with a liquid developer composition comprising toner particles of a resinous phase containing a first colorant dispersed in an insulating carrier liquid, forming a second electrostatic charge pattern on the substrate and developing the second pattern with a liquid developer composition comprising toner particles of a resinous phase containing a second colorant dispersed in an insulating carrier liquid, the improvement which comprises:

employing toner particles having incorporated therethroughout an antistatic agent which is substantially immiscible with the resinous phase and insoluble in the insulating carrier liquid, or, if soluble in the insulating carrier liquid, is substantially free of acidic or basic moieties.

15. The process of claim 14, wherein the antistatic agent is selected from the group consisting of ethoxylated sorbitan monooleate, ethoxylated oleic acid, ethoxylated oleyl alcohol and carbowaxes.

16. The process of claim 14, wherein the toner particles further comprise a separate, solid, incompatible phase which is a wax.

17. The developer composition of claim 16, wherein the wax is carnauba wax.

18. In a process for forming toner particles comprising a mixture of colorant and a resin, the particles adapted to be dispersed in a liquid electrophotographic developer composition comprising a hydrocarbon medium, in which process said colorant and said resin are admixed and then comminuted to a desired particle size, the improvement comprising:

prior to said comminution, incorporating into the mixture an antistatic agent which is substantially immiscible with the resinous phase and insoluble in the hydrocarbon medium, or, if soluble in the hydrocarbon medium, is substantially free of acidic or basic moieties.

19. In a process for forming toner particles comprising a mixture of colorant and a resin, the particles adapted to be dispersed in a liquid electrophotographic developer composition comprising a hydrocarbon medium, in which process said colorant and said resin are admixed and then comminuted to a desired particle size, the improvement comprising:

prior to said comminution, incorporating into the mixture (a) an antistatic agent which is substantially immiscible with the resinous phase and insoluble in the hydrocarbon medium, or, if soluble in the hydrocarbon medium, is substantially free of acidic or basic moieties; and (b) a separate, solid incompatible phase comprising a wax which is substantially immiscible with the resin, to provide fracture surfaces for the comminution.

* * * * *